US007751761B2

(12) United States Patent
Sato

(10) Patent No.: US 7,751,761 B2
(45) Date of Patent: Jul. 6, 2010

(54) IMAGE FORMING APPARATUS

(75) Inventor: Masahiro Sato, Kanagawa (JP)

(73) Assignee: Fuji Xerox Co., Ltd., Toyko (JP)

( * ) Notice: Subject to any disclaimer, the term of this patent is extended or adjusted under 35 U.S.C. 154(b) by 255 days.

(21) Appl. No.: 11/488,065

(22) Filed: Jul. 18, 2006

(65) Prior Publication Data

US 2007/0134027 A1 Jun. 14, 2007

(30) Foreign Application Priority Data

Dec. 13, 2005 (JP) ..... P2005-358819

(51) Int. Cl.
*G03G 15/00* (2006.01)

(52) U.S. Cl. ..... 399/299

(58) Field of Classification Search ..... 399/299
See application file for complete search history.

(56) References Cited

U.S. PATENT DOCUMENTS

| | | | | |
|---|---|---|---|---|
| 5,160,946 | A * | 11/1992 | Hwang | 347/116 |
| 5,386,286 | A | 1/1995 | Kinouchi et al. | 355/326 R |
| 6,198,890 | B1 | 3/2001 | Liu et al. | 399/107 |
| 6,389,260 | B1 * | 5/2002 | Kataoka et al. | 399/298 |
| 7,130,567 | B2 * | 10/2006 | Sudo et al. | 399/262 |
| 7,173,646 | B2 * | 2/2007 | Nakahata | 347/245 |
| 7,203,452 | B2 * | 4/2007 | Miyawaki et al. | 399/299 |
| 2001/0055499 | A1 * | 12/2001 | Sato | 399/111 |
| 2002/0031379 | A1 | 3/2002 | Miyawaki et al. | 399/299 |
| 2002/0041781 | A1 | 4/2002 | Yasui et al. | |
| 2002/0110388 | A1 | 8/2002 | Yokomori et al. | 399/167 |
| 2004/0101327 | A1 * | 5/2004 | Nomura et al. | 399/111 |
| 2004/0109704 | A1 * | 6/2004 | Abe | 399/107 |
| 2004/0126150 | A1 | 7/2004 | Noguchi et al. | |
| 2004/0136747 | A1 * | 7/2004 | Tanizaki et al. | 399/110 |
| 2004/0165910 | A1 * | 8/2004 | Sato et al. | 399/116 |
| 2004/0179869 | A1 | 9/2004 | Miyawaki et al. | 399/299 |
| 2004/0190932 | A1 * | 9/2004 | Ishii | 399/110 |
| 2004/0208670 | A1 * | 10/2004 | Abe | 399/110 |
| 2005/0030364 | A1 * | 2/2005 | Sato | 347/115 |
| 2006/0083545 | A1 * | 4/2006 | Okabe et al. | 399/111 |

FOREIGN PATENT DOCUMENTS

| | | | |
|---|---|---|---|
| CN | 1327548 | A | 12/2001 |
| CN | 1372170 | A | 10/2002 |
| CN | 1484107 | A | 3/2004 |
| CN | 1493931 | A * | 5/2004 |
| JP | 3023374 | B | 1/2000 |
| JP | 2001-209234 | | 8/2001 |
| JP | 2002-148892 | | 5/2002 |
| JP | 2002-162807 | | 6/2002 |
| JP | 2004-162807 | | 6/2004 |

* cited by examiner

*Primary Examiner*—David M Gray
*Assistant Examiner*—G. M. Hyder
(74) *Attorney, Agent, or Firm*—Morgan, Lewis & Bockius LLP

(57) ABSTRACT

An image forming apparatus includes a belt disposed diagonally with respect to a horizontal direction of the image forming apparatus, and plural image forming units disposed along the belt. Each of the plural image forming units includes a photosensitive drum that faces at least the belt and an exposing device that forms a latent image on the photosensitive drum.

5 Claims, 6 Drawing Sheets

IMAGE FORMING APPARATUS

BACKGROUND

1. Technical Field

The present invention relates to an image forming apparatus such as a printer, a facsimile, and a copier.

2. Related Art

A tandem system is known as a type of image forming apparatus. The tandem system is such that, for example, four image forming units are disposed parallel to one another around a belt to form a color image. Although the tandem system can achieve high productivity, the apparatus tends to be large in size because four image forming units need to be aligned.

SUMMARY

According to an aspect of the invention, an image forming apparatus includes a belt disposed diagonally with respect to a horizontal direction of the image forming apparatus, and plural image forming units disposed along the belt. Each of the plural image forming units includes a photosensitive drum that faces at least the belt and an exposing device that forms a latent image on the photosensitive drum.

The foregoing belt may be an intermediate transfer belt or may be a conveying belt for conveying sheets.

BRIEF DESCRIPTION OF THE DRAWINGS

Exemplary embodiments of the present invention will be described in detail based on the following figures, wherein.

DETAILED DESCRIPTION

Next, exemplary embodiments of the invention will be described with reference to the drawings.

Figure 1:
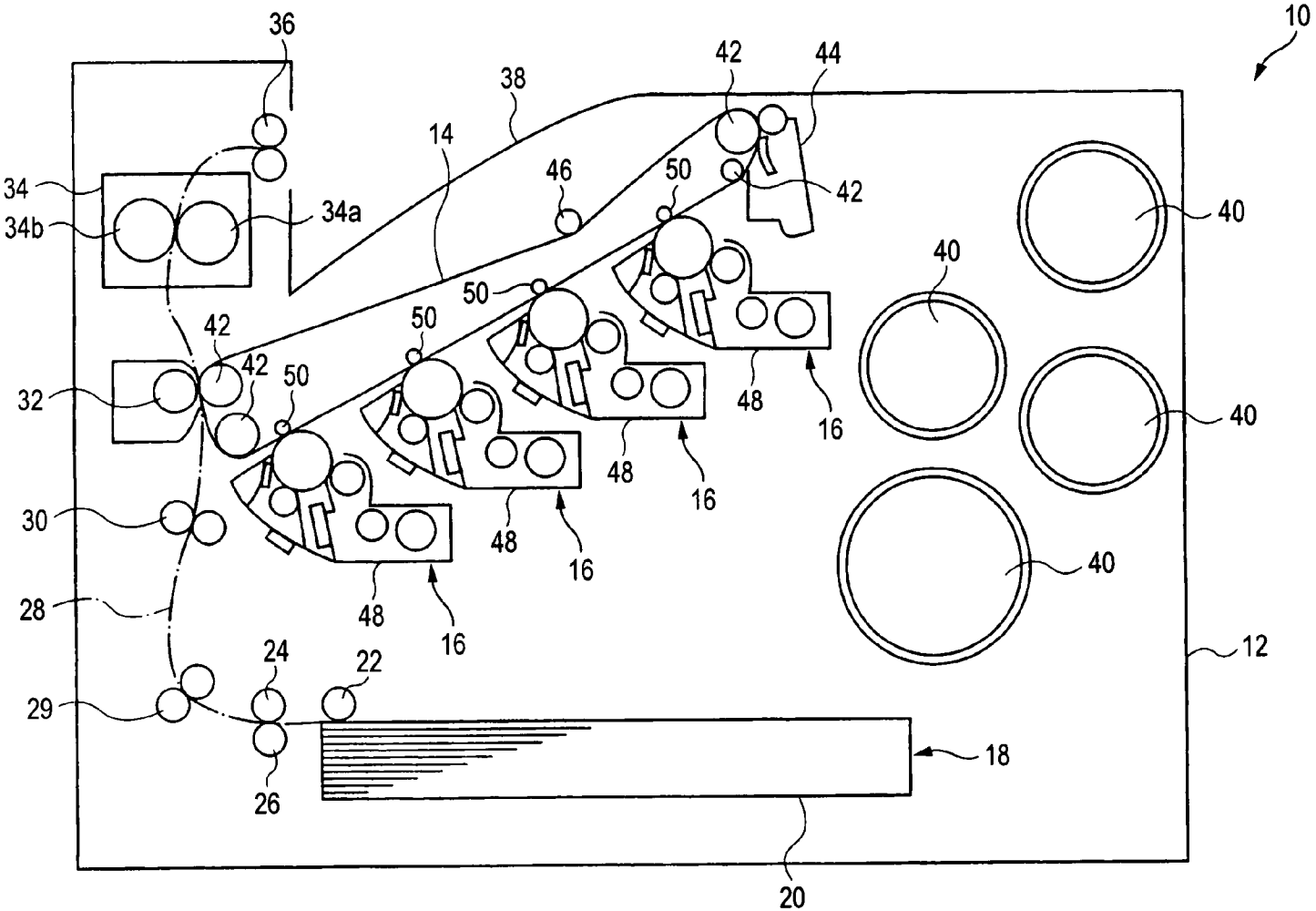
FIG. 1 is a side view showing an image forming apparatus according to the first exemplary embodiment of the invention.

FIG. 1 shows an image forming apparatus 10 according to an exemplary embodiment of the invention. The image forming apparatus 10 has an image forming apparatus main unit 12. An intermediate transfer belt 14 is disposed in the image forming apparatus main unit 12. For this intermediate transfer belt 14, four image forming device 16, for example, are disposed parallel to one another; thus, the image forming apparatus 10 is configured to form a so-called tandem system. The image forming devices 16 respectively form toner images of respective colors, yellow, magenta, cyan, and black, on the intermediate belt 14.

A sheet feeding device 18 is provided in a lower portion of the image forming apparatus main unit 12. The sheet feeding device 18 has a sheet feeding cassette 20 in which sheets are loaded, a pickup roll 22 for picking up a sheet that has been loaded in the sheet feeding cassette 20, and a feed roll 24 and a retard roll 26 for sending out the sheets while separating them. The sheet feeding cassette 20 is provided so as to be freely detachable from the image forming apparatus main unit 12 so that it can be drawn out frontward in the drawing. Sheets, which are transfer sheets such as plain paper and OHP sheet, are loaded and accommodated in the sheet feeding cassette 20.

A sheet feeding path 28 is provided near one end of the image forming apparatus main unit 12 (near the left end in the drawing) along a substantially vertical direction. Conveying rolls 29, resist rolls 30, a second transfer roll 32, a fixing device 34, and discharge rolls 36 are provided on this sheet feeding path 28. The resist rolls 30 temporarily holds the sheet that has been sent out to the sheet feeding path 28, and sends it to the second transfer roll 32 with proper timing. The fixing device 34 includes a heating roll 34*a* and a pressure roll 34*b* that apply heat and pressure to the sheet that is passing through the heating roll 34*a* and the pressure roll 34*b* to fix a toner image onto the sheet. This fixing device 34 is made into a unit and is configured to be detachable from the image forming apparatus 12.

A discharge tray part 38 is provided at the upper portion of the image forming apparatus main unit 12. The sheets on which toner images have been fixed are discharged by the above-mentioned discharge rolls 36 onto the discharge tray part 38, and are stacked on the discharge tray part 38. Thus, the sheets in the sheet feeding cassette 20 are passed through the C-shaped path one after another and are discharged to the discharge tray part 38.

Four toner bottles 40, for example, are provided in the other end portion of the image forming apparatus main unit 12 (in the right end portion in the drawing). The toner bottles 40 accommodate toners of yellow, magenta, cyan, and black, respectively. The toner bottles 40 are configured to feed the toners to the image forming devices 16 via toner feeding paths, which are not shown in the drawing.

The intermediate transfer belt 14 is supported by plural conveying rolls 42, and the belt surface on which the above-described image forming devices 16 are provided is tilted with respect to a horizontal direction. One of the conveying rolls 42 forms a backup roll of the second transfer roll 32. An intermediate belt cleaning device 44 is disposed in the vicinity of the upper end of the intermediate transfer belt 14. Another one of the conveying rolls 42 forms a backup roll of the cleaning device 44. In addition, a tension roll 46 is disposed above the intermediate transfer belt 14 so that an appropriate tension is applied to the intermediate transfer belt 14 by the tension roll 46.

The image forming devices 16 include image forming units 48 that face one surface of the intermediate transfer belt 14, and first transfer rolls 50 provided on the back surface of the intermediate transfer belt 14. The image forming units 48 are freely detachable from the image forming apparatus main unit 12, so that after being shifted downward, they can be drawn out frontward in the drawing.

Figure 2:
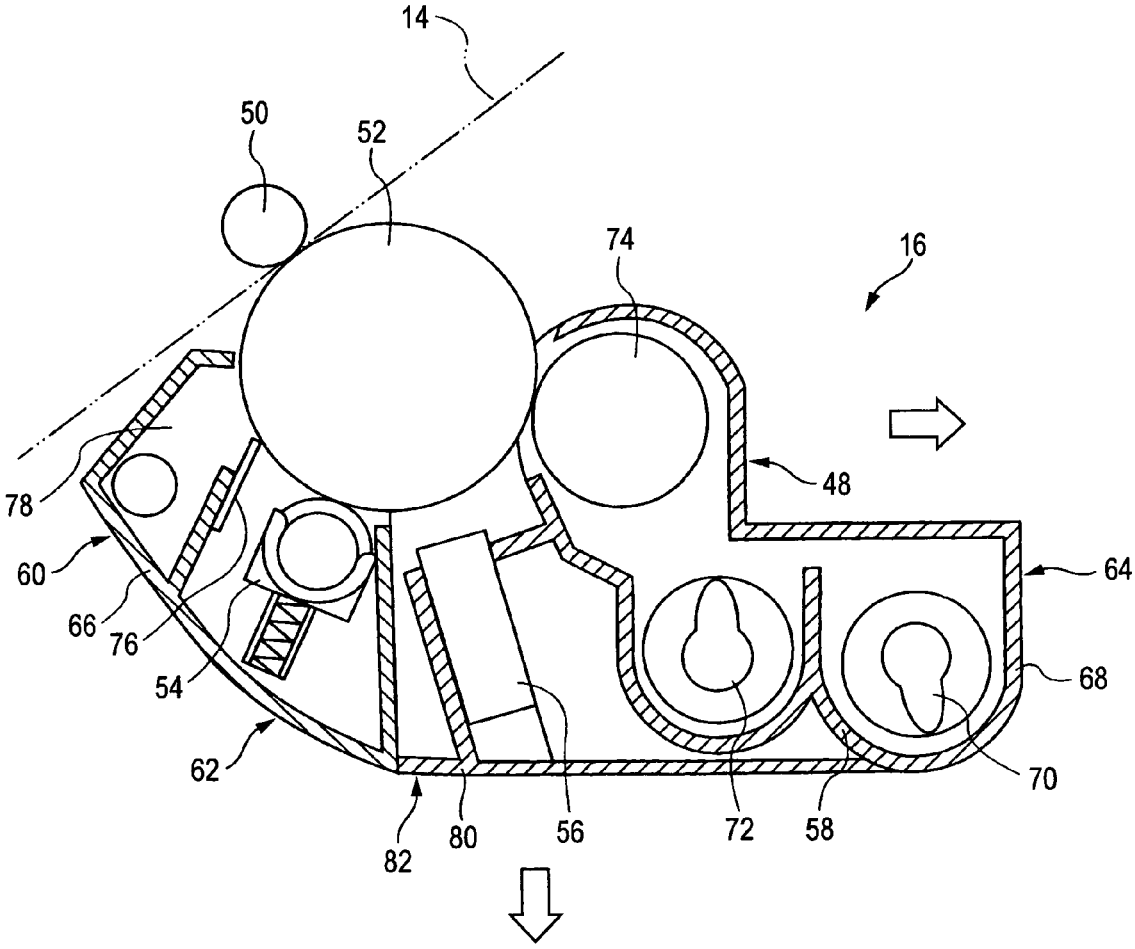
FIG. 2 is a side view showing the image forming device used for the image forming apparatus according to the first exemplary embodiment of the invention.

FIG. 2 shows the details of the image forming devices 16. The image forming unit 48 has: a photosensitive drum 52 facing the intermediate transfer belt 14; a charging device 54 for charging the photosensitive drum 52 which is made of, for example, a roll; an exposing device 56 for forming a latent image on the photosensitive drum 52 made of, for example, an LED (light emitting diode); a developing device 58 for developing the latent image formed on the photosensitive drum 52 by the exposing device 56 with a toner; and a cleaning device 60 for cleaning the toner remaining on the photosensitive drum 52 after the transferring.

In this exemplary embodiment, the image forming unit 48 is constructed by coupling a photosensitive drum unit 62 and a developing unit 64, which can be separated from each other. The photosensitive drum unit 62 accommodates the photosensitive drum 52, the charging device 54, the exposing device 56, and the cleaning device 60 within a first housing 66. The developing device 58 is accommodated within a second housing 68 in the developing unit 64. The first housing 66 and the second housing 68 are detachably coupled to construct the image forming unit 48. The developing unit 64 can be separated, after the image forming unit 48 is drawn out of the image forming apparatus main unit 12, by pulling the developing unit 64 toward the far side of the photosensitive drum unit, as indicated by the arrow in the drawing. In the case where the image forming unit 48 is collected from the user because of the end of its life or defects, the image forming unit 48 can be recycled by replacing only the developing unit 64 when the developing unit 64 had a problem. Moreover, when replacing another component because of the end of its life or the like, the replacing work can be made easily by separating the developing unit 64.

The exposing device 56 is accommodated in a third housing 80 to construct an exposing unit 82. The exposing unit 82 is also coupled to be detachable from the photosensitive drum unit 62 and the developing unit 64. The exposing unit 82 can be separated, after the image forming unit 48 is drawn out from the image forming apparatus main unit 12, by pulling it downward, as indicated by the arrow in the drawing. The exposing device 56 has a longer lifespan than the photosensitive drum 52, the developing device 58, and so forth. When the image forming unit 48 is collected from the user because of either the end of its life or defects, the exposing unit 82 can be recycled by separating it therefrom and making a simple adjustment or the like thereto.

The developing device 58 adopts a two-component system, and uses a developing agent containing a toner and a carrier. The developing device 58 has, for example, two augers 70 and 72 disposed horizontally parallel to each other, and a developing roll 74 disposed diagonally above the discharging-side auger 72. The augers 70 and 72 stir the developing agent and feed it to the developing roll 74. A magnetic brush originating from the carrier is formed on the developing roll 74, and by this magnetic brush, the toner adhering to the carrier is conveyed so that the latent image on the photosensitive drum 52 is developed by the toner. Since the developing roll 74 is disposed above the augers 70 and 72 in the two-component system developing device 58 in this exemplary embodiment, the developing agent is prevented from gathering, and the developing agent can be stirred uniformly, whereby the development performance can be maintained.

The cleaning device 60 includes a toner scraping-off part 76 made of, for example, a blade, and a collecting part 78 for collecting the toner that has been scraped off by the toner scraping-off part 76.

Figure 3:
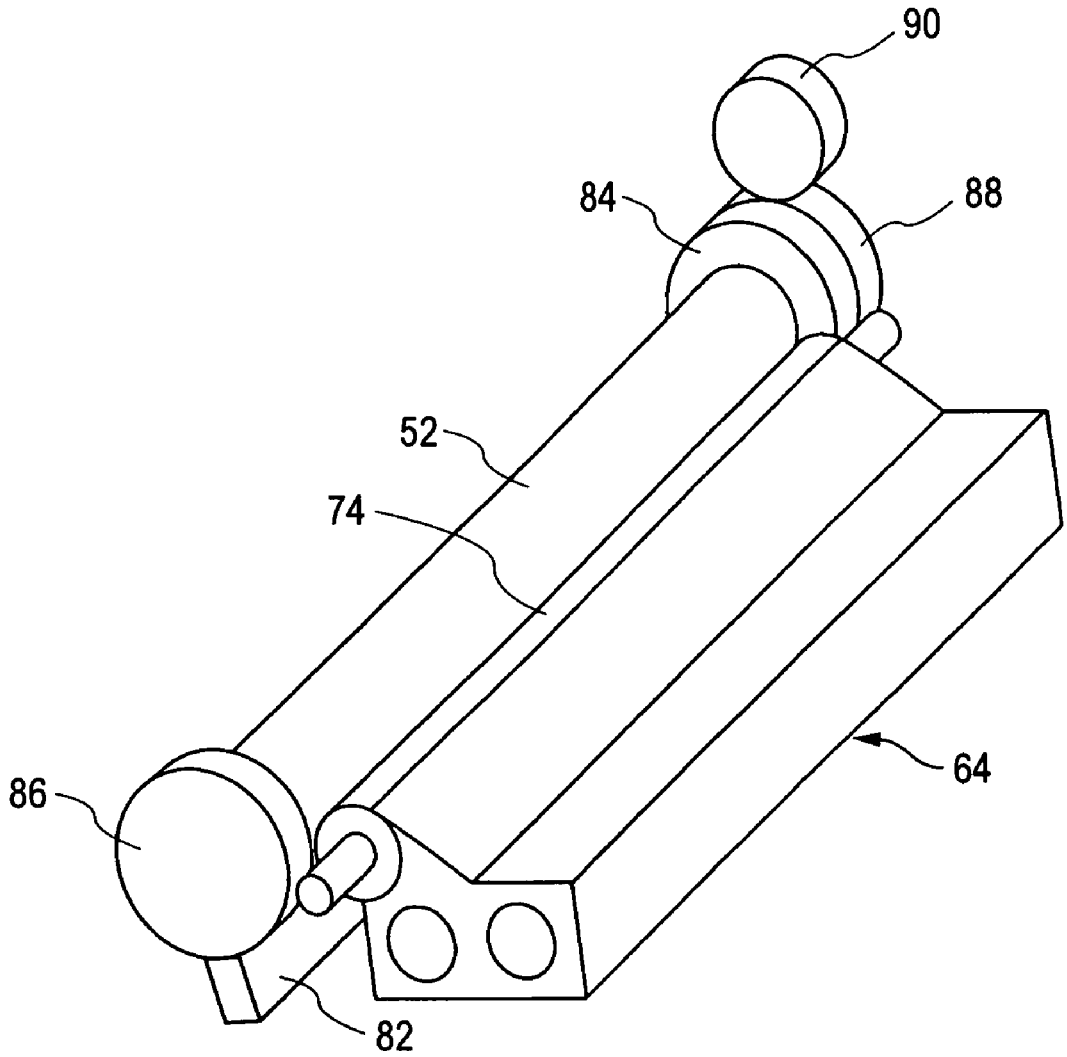
FIG. 3 is a perspective view showing the positioning state of the photosensitive drum, the developing unit, and the exposing unit that are used for the image forming apparatus according to the first exemplary embodiment of the invention.

The above-mentioned photosensitive drum 52 is, as shown in FIG. 3, provided with bearings 84 and 86 on the outer circumferences of both sides thereof and, is supported by the bearings 84 and 86 to be freely rotatable. Since the outer circumference of the photosensitive drum 52 is supported by the bearings 84 and 86 in this way, periodic variations in the photosensitive drum 52 portion due to vibrations or the like can be reduced. This is because the photosensitive drum is directly supported without positioning interposed components, in contrast to the conventionally adopted system in which the photosensitive drum is supported via a flange or the like.

A photosensitive drum gear 88 is fixed to the outside of the bearing 84 on one side of the photosensitive drum 52. An input gear 90 meshes with the photosensitive drum gear 88 so that the photosensitive drum 88 can be rotated via the input gear 90 and the photosensitive drum gear 88. The exposing unit 82 and the developing roll 74 of the developing unit 64 are in contact with the bearings 84 and 86. Thus, the positioning of the developing roll 74 and the exposing device 56 relative to the photosensitive drum 52 can be made stably with high precision.

Figure 4:
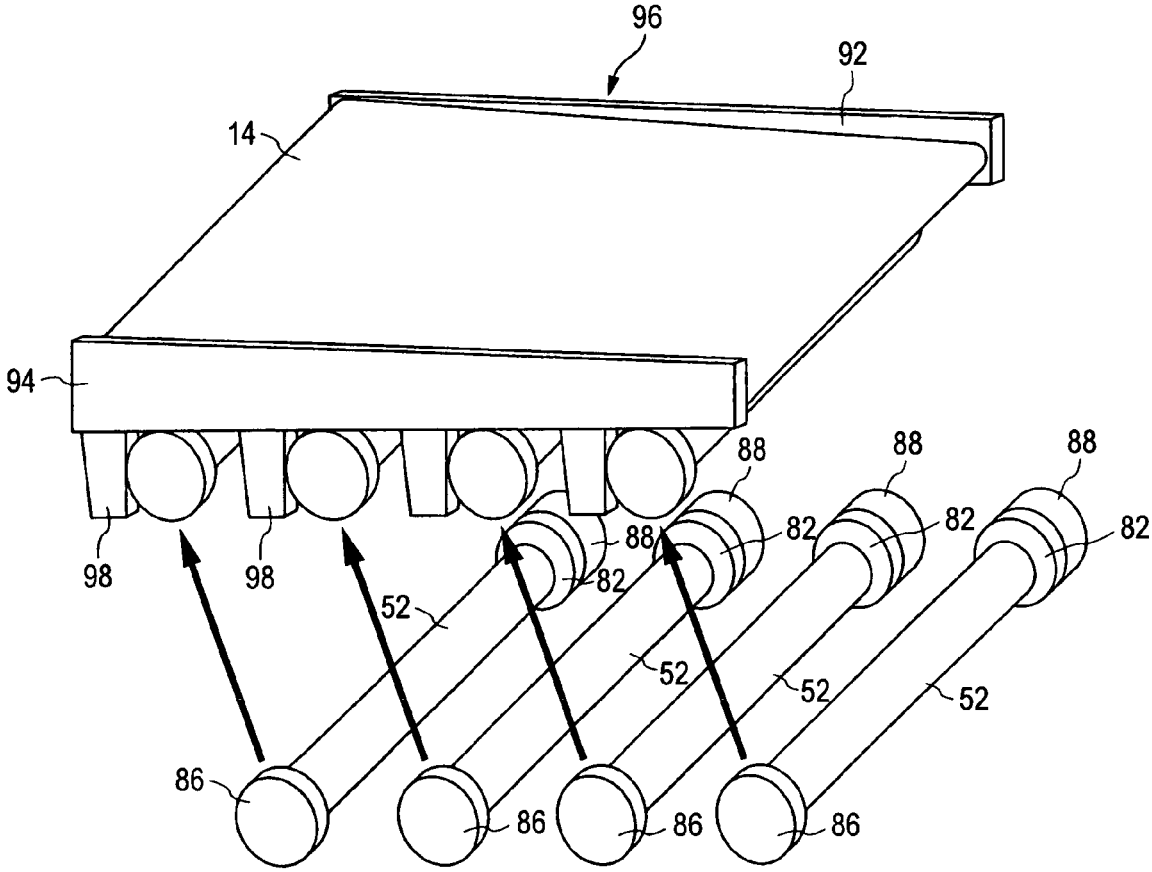
FIG. 4 is a perspective view showing the positioning state of the photosensitive drum and the intermediate transfer unit that are used for the image forming apparatus according to the first exemplary embodiment of the invention.

As shown in FIG. 4, the above-described intermediate transfer belt 14 is supported by support members 92 and 94 at both sides thereof to construct a transfer unit 96. Each of the support members 92 and 94 has four positioning parts 98, which project downward, that correspond to the photosensitive drums 52. The bearings 84 and 86 of the photosensitive drums 52 are in contact with the positioning parts 98 so that the positioning of the photosensitive drums 52 relative to the intermediate transfer belt 14 is made.

It should be noted that the transfer unit 96 is freely detachable from the image forming apparatus main unit 12 so that it can be drawn out frontward in FIG. 1.

In the above-described configuration, the intermediate transfer belt 14 and the photosensitive drums 52 rotate in opposite directions in synchronization with each other. The charging devices 54 charge the surfaces of the photosensitive drums 52, and the exposing devices 56 form latent images. The latent images on the photosensitive drums 52, which have been formed by the exposing devices 56, are developed by the developing devices 58. The toner images developed by the developing devices 58 are transferred onto the intermediate transfer belt 14 by the first transfer rolls 50. The toner images of different colors formed by the respective image forming devices 16 are overlapped on the intermediate transfer belt 14 as it moves.

Meanwhile, sheets stacked in the sheet feeding cassette 20 of the sheet feeding device 18 are fed one by one to the sheet feeding path 28 by the pickup roll 22, the feed roll 24, the retard roll 26, and so forth. The sheet fed to the sheet feeding path 28 is brought into contact with the resist rolls 30, where it is held temporarily, and is sent to the second transfer roll 32 with appropriate timing. Then, by this second transfer roll 32, the toner image on the intermediate transfer belt 14 is transferred to the sheet. The sheet on which the toner image has been transferred is further sent to the fixing device 34, where the toner image is fixed to the sheet by heat and pressure. The sheet on which the toner image has been fixed by the fixing device 34 is discharged to the discharge tray part 38 by the discharge rolls 36.

Such a tandem-type image forming apparatus 10 tends to be large in size because, for example, four image forming devices 16 are lined up along the intermediate transfer belt 14. In this exemplary embodiment, size reduction is achieved by tilting the intermediate transfer belt 14 with respect to the horizontal direction and optimizing the layout of the plural image forming devices 16 relative to one another.

Figure 5:
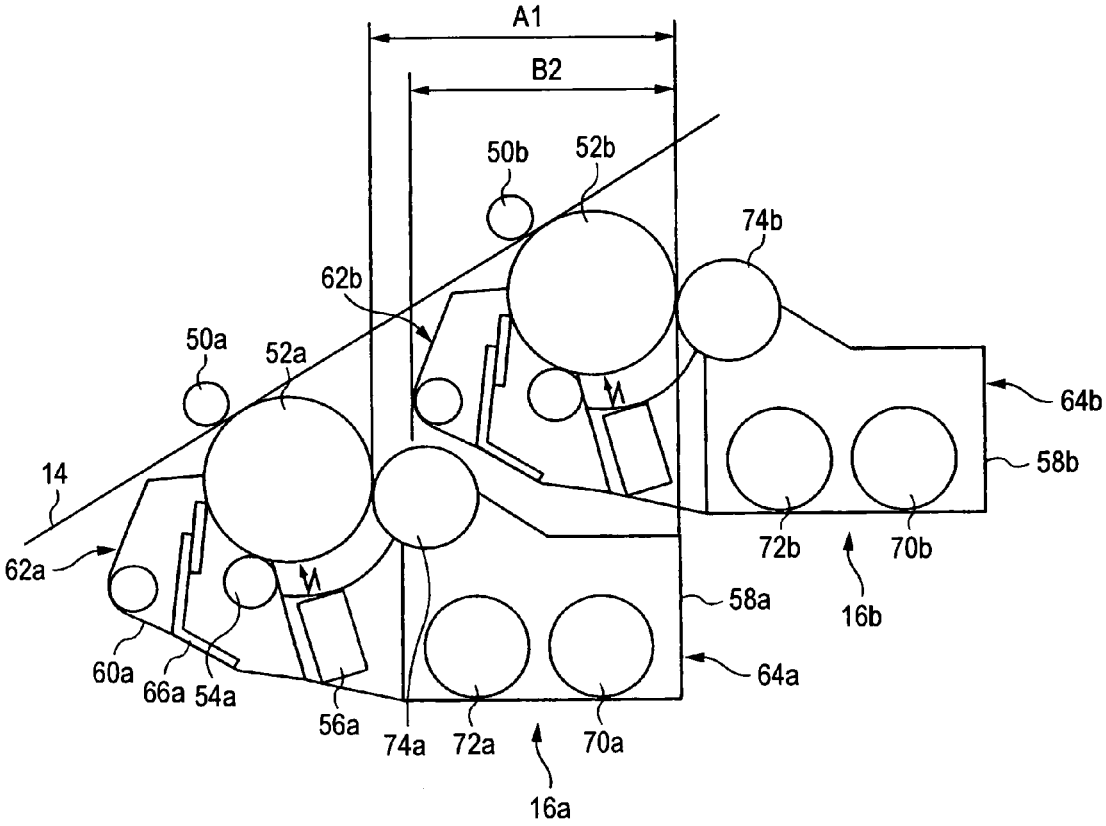
FIG. 5 is a side view showing the positional relationship between the image forming device used for the image forming apparatus according to the first exemplary embodiment of the invention.

FIG. 5 shows the positional relationship between the plural the image forming devices 16. In FIG. 5, the constituent components of a first image forming device 16*a* are denoted by suffixing "a" to the reference numerals, and the constituent components of a second image forming device 16*b*, which is disposed adjacent to and above the first image forming device 16*a*, are denoted by suffixing "b" to the reference numerals. In this exemplary embodiment, a photosensitive drum unit 62*b* of the second image forming device 16*b* is disposed vertically above a developing device 58*a* of the first image forming device 16*a* so that a horizontal width B2 of the photosensitive drum unit 62*b* comes within a horizontal width A1 of a developing device 58*a* of the first image forming device 16*a*. Thus, a photosensitive drum 52*b*, a charging device 54*b*, an exposing device 56*b*, and a cleaning device 60*b* of the second image forming device 16*b* are disposed vertically above the first image forming device 16*a*. Therefore, the apparatus is made compact by an amount corresponding to the size of the overlap of the devices. In this exemplary embodiment, the entirety of the photosensitive drum unit 62*b* is vertically overlapped with the developing device 52*a*. However, as for the components other than the cleaning device 60*b*, namely, as for the photosensitive drum 52*b*, the charging device 54*b*, and the exposing device 56*b*, only portions thereof may be vertically overlapped with the developing device 58*a*.

The reason why the photosensitive drum unit 58*b* can be disposed above the developing device 58*a* is that the image forming unit 48*b* is provided with the exposing device 56*b* so that a light path can be ensured.

A first transfer roll 50*b* of the second image forming device 16*b* is disposed vertically above the developing device 58*a* of the first image forming device 16*a* so that the first transfer roll 50*b* of the second image forming device 16*b* comes within the horizontal width A the developing device 58*a* of the first image forming device 16*a*. In this exemplary embodiment, the entirety of the first transfer roll 50*b* is vertically overlapped with the developing device 58*a*, but only a portion of the first transfer roll 50*b* may be overlapped with the developing device 58*a*.

Figure 6:
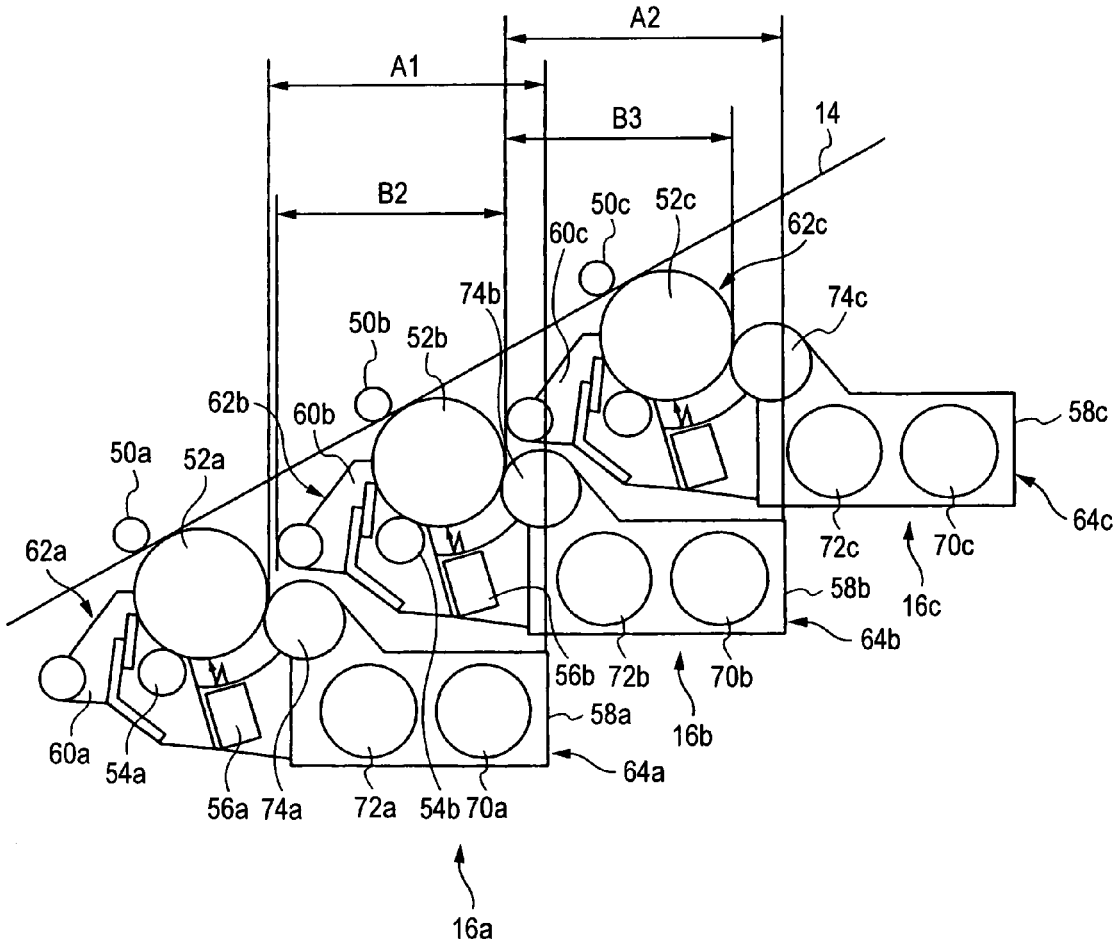
FIG. 6 is a side view showing the positional relationship between the image forming device used for the image forming apparatus according to the second exemplary embodiment of the invention.

FIG. 6 shows another exemplary embodiment. In FIG. 6, the constituent components of the first image forming device 16*a* are denoted by suffixing "a" to the reference numerals, the constituent components of the second image forming device 16*b*, which is disposed adjacent to and above the first image forming device 16*a*, are denoted by suffixing "b" to the reference numerals, and the constituent components of a third image forming device 16*c*, which is disposed adjacent to and above the second image forming means 16*b*, are denoted by suffixing "c" to the reference numerals.

In this exemplary embodiment, the horizontal width B2 of the photosensitive drum unit 62*b* of the second image forming device 16*b* comes within the horizontal width A1 of the developing device 58*a* of the first image forming device 16*a*, and moreover, a portion of a horizontal width B3 of a photosensitive drum unit 62*c* of the third image forming device 16*c* also comes within the horizontal width A1. Specifically, the entirety of the photosensitive drum unit 62*b* and the first transfer roll 50*b* of the second image forming device 16*b*, and a portion of a cleaning device 60*c* which is a portion of the photosensitive drum unit 62*c* of the third image forming device 16*c*, are disposed vertically within the horizontal width A1 of the developing device 58*a* of the first image forming device 16*a*. Therefore, in this exemplary embodiment, the apparatus is made even more compact than the previously-described exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a belt disposed diagonally with respect to a horizontal direction of the image forming apparatus; and a plurality of detachably mountable image forming units disposed along the belt, each of the plurality of detachably mountable image forming units including a photosensitive drum that faces at least the belt and an exposing device that forms a latent image on the photosensitive drum and a developing device that develops the latent image formed on the photosensitive drum with a toner, wherein an outer circumference of the photosensitive drum is supported by bearings, wherein each of the plurality of detachably mountable image forming units further comprises a charging device that charges the photosensitive drum, wherein within a horizontal width of the developing device of one of the plurality of detachably mountable image forming units, at least a portion of the exposing device of an adjacent one of the plurality of detachably mountable image forming units is disposed vertically, and wherein the exposing device is housed in the corresponding image forming unit, wherein each of the plurality of detachably mountable image forming units further comprises a cleaning device that cleans the toner remaining on the photosensitive drum.

2. The image forming apparatus according to claim 1, wherein, within a horizontal width of the developing device of one of the plurality of detachably mountable image forming units, at least a portion of the cleaning device of an adjacent one of the plurality of detachably mountable image forming units is disposed vertically.

3. The image forming apparatus according to claim 1, further comprising a plurality of toner cartridges are lateral to the belt and the plurality of detachably mountable image forming units.

4. The image forming apparatus according to claim 1, further comprising a plurality of toner cartridges are lateral to the belt and the plurality of detachably mountable image forming units.

5. The image forming apparatus according to claim 2, further comprising a plurality of toner cartridges are lateral to the belt and the plurality of detachably mountable image forming units.

* * * * *